US010689187B2

(12) United States Patent
Urushidani

(10) Patent No.: US 10,689,187 B2
(45) Date of Patent: Jun. 23, 2020

(54) ROTOR SECURING JIG AND ROTOR STORAGE UNIT

(71) Applicant: MITSUBISHI HEAVY INDUSTRIES COMPRESSOR CORPORATION, Tokyo (JP)

(72) Inventor: Hiroki Urushidani, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 0 days.

(21) Appl. No.: 16/328,862

(22) PCT Filed: Nov. 28, 2016

(86) PCT No.: PCT/JP2016/085136
§ 371 (c)(1),
(2) Date: Feb. 27, 2019

(87) PCT Pub. No.: WO2018/096670
PCT Pub. Date: May 31, 2018

(65) Prior Publication Data
US 2019/0185256 A1 Jun. 20, 2019

(51) Int. Cl.
*B65D 85/68* (2006.01)
*B65D 25/10* (2006.01)
(Continued)

(52) U.S. Cl.
CPC ..... *B65D 85/68* (2013.01); *B65D 25/107* (2013.01); *B65D 90/0053* (2013.01);
(Continued)

(58) Field of Classification Search
CPC .. B65D 85/68; B65D 90/0053; B65D 25/107; B65D 2585/6875; B65D 2585/6805; F04D 29/62; F05B 2260/02
(Continued)

(56) References Cited

U.S. PATENT DOCUMENTS 724,086 A * 3/1903 Davis ..... G01B 3/16 33/558.04
796,212 A * 8/1905 Horsell ..... G01K 1/14 492/11
3,927,763 A * 12/1975 Strub ..... F04D 17/125 206/319
(Continued)

FOREIGN PATENT DOCUMENTS

EP 1586515 A1 * 10/2005 ..... B65D 88/745
EP 3034433 A1 * 6/2016 ..... B65D 85/68
JP 2013-036387 A 2/2013

OTHER PUBLICATIONS

Innternational Search Report and Written Opinion in corresponding International Application No. PCT/JP2016/085136, dated Feb. 14, 2017 (11 pages).

*Primary Examiner* — Chun Hoi Cheung
*Assistant Examiner* — Brijesh V. Patel
(74) *Attorney, Agent, or Firm* — Osha Liang LLP

(57) ABSTRACT

A rotor securing jig secures a rotor extending along an axis inside a container. The rotor securing jig includes a first member that is able to be secured to a first end portion of the rotor, which is an end portion of the rotor on a first side in an axial direction, a second member that is provided relatively movable in the axial direction with respect to the first member, and a third member that is secured to the container, has a first abutting surface facing a second side in the axial direction, which is an opposite side to the first side, and abutting the first member, and has a second abutting surface facing the first side and abutting the second member.

11 Claims, 4 Drawing Sheets

(51) Int. Cl.
*F04D 29/62* (2006.01)
*B65D 90/00* (2006.01)

(52) U.S. Cl.
CPC ..... *F04D 29/62* (2013.01); *B65D 2585/6805* (2013.01); *B65D 2585/6875* (2013.01); *F05B 2260/02* (2013.01)

(58) Field of Classification Search
USPC ..... 206/319, 335, 433; 310/273; 464/184
See application file for complete search history.

(56) References Cited

U.S. PATENT DOCUMENTS 3,955,704 A * 5/1976 Smith ..... B65D 81/022 220/507
4,032,255 A * 6/1977 Iizuka ..... F01D 25/24 415/232
4,174,036 A * 11/1979 Beckman ..... B65D 81/022 206/223
4,938,661 A * 7/1990 Kobayashi ..... F04D 29/444 415/199.1
5,564,186 A 10/1996 Hori et al.
6,462,459 B1 * 10/2002 Kirkman ..... B65D 5/5038 206/319
2008/0099358 A1 * 5/2008 Bell ..... B65D 25/10 206/448
2014/0178119 A1 6/2014 Shinohara et al.
2014/0178183 A1 * 6/2014 Masuda ..... F04D 29/4206 415/173.1

* cited by examiner

ROTOR SECURING JIG AND ROTOR STORAGE UNIT

TECHNICAL FIELD

The invention relates to a rotor securing jig and a rotor storage unit.

BACKGROUND ART

A rotary machine, such s a centrifugal compressor, has a rotating unit in which a member, such as an impeller, is attached to a rotor and a stationary unit which rotatably supports the rotor. When delivering this rotary machine to a customer, a rotary shaft vibrates with respect to the stationary unit due to vibration during transporting. When such vibration occurs, the rotating unit and the stationary unit come into contact with each other and thereby damage is caused. Thus, there is a possibility that the performance of the rotary machine is impaired.

A jig for suppressing such vibration during transporting is disclosed in, for example, Patent Document 1. The jig disclosed in Patent Document 1 includes a plate that abuts an end portion of a rotary shaft and a restraining member that retrains the plate in an axial direction and a rotation direction with respect to a stationary unit. By the rotary shaft being restrained in the axial direction and the rotation direction with respect to a stationary member via the plate, the vibration of the rotating unit with respect to the stationary unit during transporting is suppressed.

When delivering a rotary machine to a customer, not only the rotary machine in which the rotating unit and the stationary unit are combined with each other but also a spare rotor is delivered together in some cases. At this time, the rotor is transported and kept in a state of being stored inside a container.

Even in a case where the rotor is stored inside the container, the vibration of rotor with respect to the container occurs during transporting. Thus, a structure in which both ends of the rotor are secured to the container and the position of the rotor in the axial direction with respect to the container is secured is used in some cases. However, the container is placed horizontally during transporting, and is placed vertically during keeping in some cases.

CITATION LIST

Patent Literature

[Patent Document 1] Japanese Unexamined Patent Application, First Publication No. 2013-36387

SUMMARY OF INVENTION

Technical Problem

However, in a case where the container is placed vertically in a state where both ends of the rotor are secured, the rotor inside the container also comes into a state of being risen in a vertical direction. When the rotor is kept in the long term in such a state, there is a possibility that an end portion thereof on a lower side in the vertical direction deforms due to the weight of the rotor. In order to respond to this, it is necessary to perform work with the container being emptied after transportation such that a gap is provided between the end portion of the rotor on the lower side in the vertical direction and the container. For this reason, there is a demand for securing the position of the rotor in the axial direction with respect to the container without securing an end portion of the rotor on one side in the axial direction to the container.

An object of the present invention is to provide a rotor securing jig and a rotor storage unit that can secure the position of a rotor in an axial direction with respect to a container without securing an end portion of the rotor on one side in the axial direction to the container.

Solution to Problem

According to a first aspect of the present invention, there is provided a rotor rotating jig that secures a rotor extending along an axis inside a container. The rotor securing jig includes a first member that is able to be secured to a first end portion of the rotor, which is an end portion of the rotor on a first side in an axial direction, a second member that is provided relatively movable in the axial direction with respect to the first member, and a third member that is secured to the container, and has a first abutting surface facing a second side in the axial direction, which is an opposite side to the first side, and configured to abut the first member, and a second abutting surface facing the first side and configured to abut the second member.

According to such a configuration, the first member abuts the first abutting surface, the second member abuts the second abutting surface, and the third member is sandwiched between the first member and the second member by relatively moving the second member so as to approach the first member. As a result, the positions of the first member and the second member in the axial direction with respect to the third member are secured. Accordingly, the position of the first member, which is secured to the first end portion of the rotor, in the axial direction with respect to the third member, which is secured to the container, is secured. Therefore, the position of the rotor in the axial direction with respect to the container can be secured only with the first end portion of the rotor.

According to a second aspect of the present invention, in the rotor securing jig of the first aspect, the first member has a cylindrical portion which is configured to allow the first end portion to be inserted therein from the second side in the axial direction. The second member has an insertion portion which is configured to be inserted into the cylindrical portion from the first side and a flange portion which protrudes outward from an end portion of the insertion portion on the first side in a radial direction. The first member and the second member is relatively movable in a state where the insertion portion is inserted in an inner circumferential surface of the cylindrical portion. The first abutting surface of the third member comes into contact with the cylindrical portion, and the second abutting surface comes into contact with the flange portion.

According to such a configuration, the relative movement of the second member in the axial direction with respect to the first member can be guided by inserting the insertion portion into the cylindrical portion. In addition, the third member is sandwiched between the flange portion and the cylindrical portion by the flange portion, which protrudes from the insertion portion, and the cylindrical portion abutting the third member, in a state where the insertion portion is inserted in the cylindrical portion. In this manner, with a simple configuration where the first member is provided with the cylindrical portion and the second member is provided with the insertion portion and the flange portion, the second member can be stably and relatively moved with respect to the first member while the positions of the first member and the second member in the axial direction with respect to the third member can be secured.

According to a third aspect of the present invention, in the rotor securing jig of the second aspect, the cylindrical portion has a cylindrical shape. The insertion portion has a columnar shape having an outer circumferential surface that is configured to come into sliding contact with the inner circumferential surface of the cylindrical portion. The first member and the second member is relatively movable by engaging a female screw portion formed in the inner circumferential surface of the cylindrical portion with a male screw portion formed in the outer circumferential surface of the insertion portion.

According to such a configuration, the relative position of the second member with respect to the first member can be secured and moved simply by rotating and inserting the insertion portion into the cylindrical portion. Therefore, the relative position of the second member with respect to the first member can be adjusted with high accuracy, and the position of the rotor in the axial direction with respect to the container can be secured.

According to a fourth aspect of the present invention, in the rotor securing jig of the third aspect, a first hole recessed in the radial direction is formed in an outer circumferential surface of the cylindrical portion.

According to such a configuration, a stick-shaped member is plugged into the first hole, and the cylindrical portion can be rotated.

According to a fifth aspect of the present invention, in the rotor securing jig of the third aspect or the fourth aspect, a second hole recessed in the radial direction is formed in an outer circumferential surface of the flange portion.

According to such a configuration, the stick-shaped member is plugged into the second hole, and the cylindrical portion can be rotated.

According to a sixth aspect of the present invention, there is provided a rotor storage unit including the rotor securing jig according to any one of the first aspect to the fifth aspect and a container to which a third member of the rotor securing jig is secured, in which an inside of the container is sealable.

Advantageous Effects of Invention

According to the present invention, the position of the rotor in the axial direction with respect to the container can be secured without securing the end portion of the rotor on one side in the axial direction to the container.

DESCRIPTION OF EMBODIMENTS

Hereinafter, an embodiment of a rotor storage unit 1 of the present invention will be described with reference to the drawings.

Figure 1:
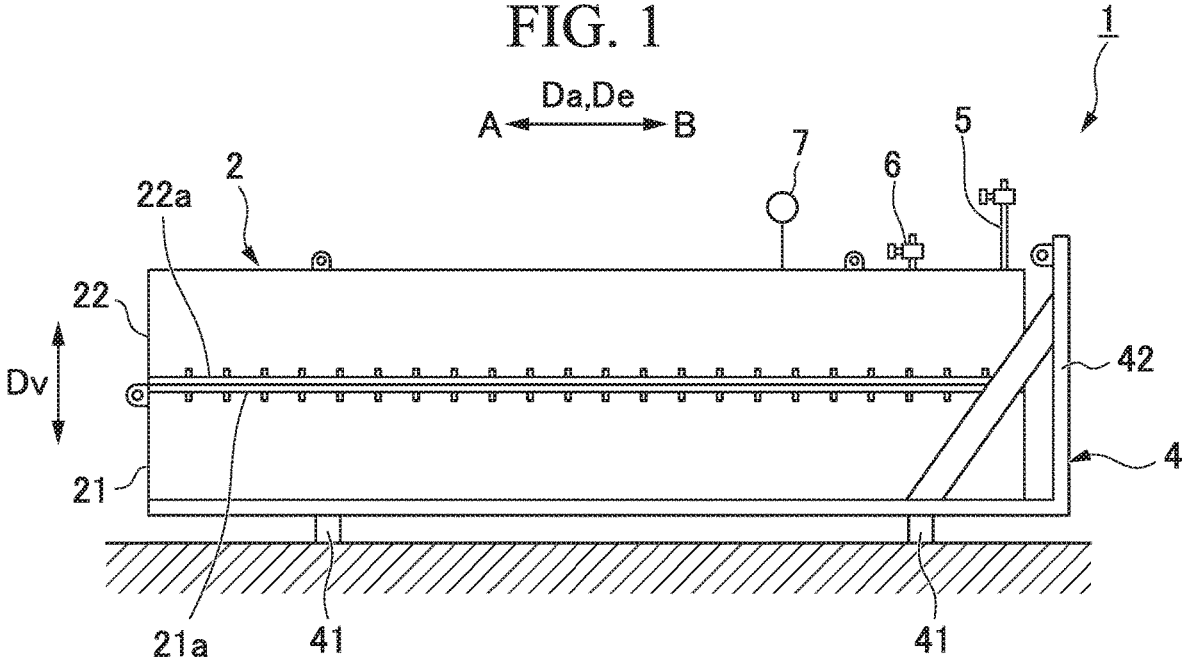
FIG. 1 is a schematic view showing appearance of a rotor storage unit according to an embodiment.
Figure 2:
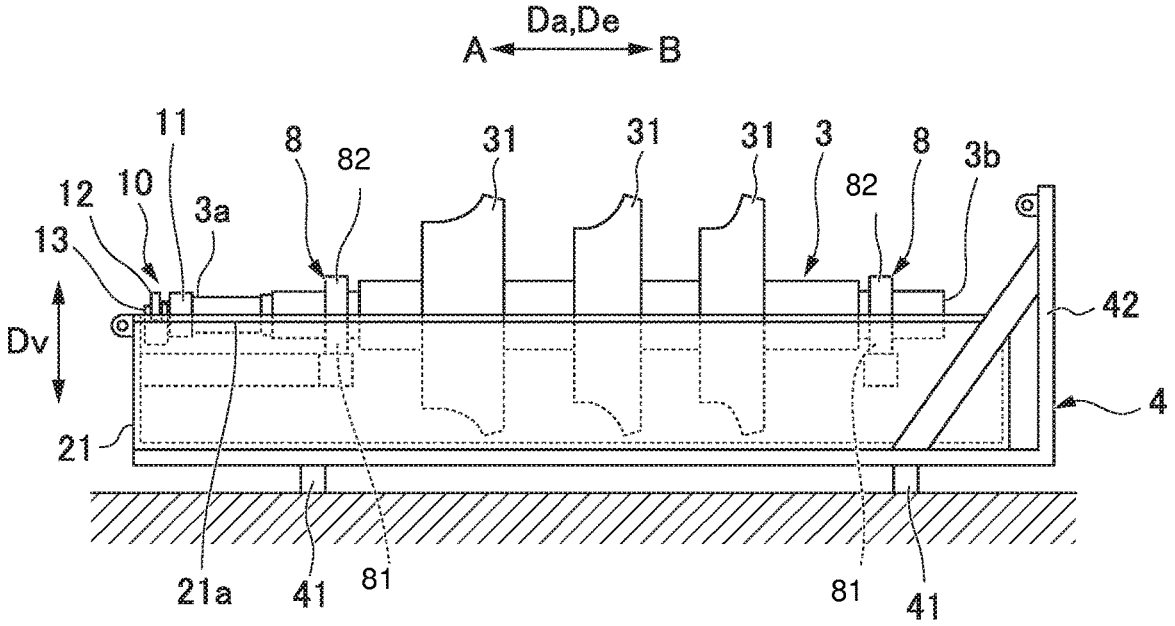
FIG. 2 is a side view showing appearance in which an upper half portion of the rotor storage unit according to the embodiment is open.

As shown in FIGS. 1 and 2, the rotor storage unit 1 is used in transporting and keeping a rotor 3 in a state where the rotor 3 is stored therein. The rotor storage unit 1 includes a container 2, a container supporting body 4, a discharge valve 5, a supply valve 6, a pressure gauge 7, a first rotor securing jig (rotor securing jig or axial-direction securing jig) 10, and second rotor securing jigs (radial-direction securing jigs) 8.

The container 2 can store the rotor 3 therein. Herein, the rotor 3 stored inside the container 2 extends along an axis. A plurality of (three, in the embodiment) impellers 31 are separated apart from each other in an axial direction Da, which is a direction where the rotor 3 extends, and are secured to the rotor 3. In the embodiment, one side in the axial direction Da of the rotor 3 will be referred to as a first side A. In addition, the other side in the axial direction Da of the rotor 3, which is an opposite side to the first side A, will be referred to as a second side B. An end portion of the rotor 3 on the first side A will be referred to as a first end portion 3*a*. An end portion of the rotor 3 on the second side B will be referred to as a second end portion 3*b*.

The container 2 of the embodiment has a cylindrical shape. Accordingly, the container 2 is formed in a box shape. The container 2 can store the rotor 3 in a sealed space therein. The container 2 is formed such that a center axis thereof matches the axis of the stored rotor 3. That is, the container 2 has a bottomed cylindrical shape that extends such that an extending direction De thereof matches the axial direction Da of the rotor 3. Accordingly, the container 2 is formed in a bottomed box shape. Therefore, the extending direction De and the axial direction Da are the same direction in the embodiment. In a case of disposing the rotor 3 inside or when transporting the rotor 3, the container 2 is placed horizontally such that the extending direction De is orthogonal to a vertical direction Dv (refer to FIG. 1). In addition, in a case of keeping the rotor 3 in the long term, the container 2 is placed vertically such that the extending direction De thereof matches the vertical direction Dv (refer to FIG. 8). When vertically placed, the container 2 is disposed such that the first end portion 3*a* of the rotor 3 is positioned on an upper side in the vertical direction Dv. The container 2 has a lower half container 21 and an upper half container 22.

The lower half container 21 has a semicylindrical shape of which an upper portion in the vertical direction Dv is open in a horizontally placed state. Accordingly, the lower half container 21 is formed in a half box shape. A lower half flange 21*a*, which has a plate shape protruding toward an outer side is formed over the entire perimeter of an opening, on the lower half container 21.

The upper half container 22 has a semicylindrical shape of which a lower portion in the vertical direction Dv is open in the horizontally placed state. Accordingly, the upper half container 22 is formed in a half box shape. An upper half flange 22*a*, which has a plate shape protruding toward the outer side is formed over the entire perimeter of the opening, on the upper half container 22. The container 2 of which an inside is sealable is configured by the upper half flange 22*a* being bolted to the lower half flange 21*a* at a plurality of places in a state where the upper half container 22 and the lower half container 21 are opposed to the opening and are combined with together.

The container supporting body 4 is a cradle that supports the container 2 when the container 2 is laid on the floor. The container supporting body 4 has a first supporting portion 41 that supports the container 2 with respect to the floor in a case where the container 2 is placed horizontally and a second supporting portion 42 that supports the container 2 with respect to the floor in a case where the container 2 is placed vertically.

The discharge valve 5 discharges a gas which is inside the container 2. As shown in FIG. 1, the discharge valve 5 is attached to the upper half container 22.

The supply valve 6 supplies a gas (for example, nitrogen) suitable for keeping the rotors into the container 2. The supply valve 6 is attached to the upper half container 22.

The pressure gauge 7 measures and displays the internal pressure of the container 2. The pressure gauge 7 is attached to the upper half container 22.

As shown in FIG. 2, the first rotor securing jig 10 secures the rotor 3 inside the container 2. The first rotor securing jig 10 regulates the movement of the rotor 3, which is stored inside the container 2, in the axial direction Da. As shown FIG. 3, the first rotor securing jig 10 of the embodiment can restrain the position of the first end portion 3*a* of the rotor 3 in the axial direction Da with respect to the container 2. The first rotor securing jig 10 restrains only the first end portion 3*a* of the rotor 3, and does not restrain the second end portion 3*b*. The second end portion 3*b* of the rotor 3 of the embodiment is disposed at a position with a gap placed between the container 2 and the second end portion 3*b*. As shown in FIG. 4, the first rotor securing jig 10 has a first member 11, a second member 12, and a third member 13.

Figure 5:
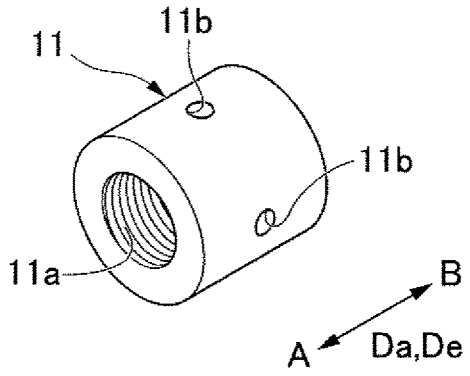
FIG. 5 is a perspective view showing appearance of a first member according to the embodiment.

The first member 11 can be secured to the first end portion 3*a* of the rotor 3. As shown in FIG. 5, the first member 11 has a cylindrical portion 111. The first end portion 3*a* can be inserted into the cylindrical portion 111 from the second side B in the axial direction Da. The cylindrical portion 111 of the embodiment has a cylindrical shape. A female screw portion 11*a* is formed in an inner circumferential surface of the cylindrical portion 111. The female screw portion can engage with a male screw portion (not illustrated) formed in an outer circumferential surface of the first end portion 3*a* of the rotor. A plurality of first holes 11*b*, which are recessed from an outer circumferential surface of the cylindrical portion 11 toward an inner side in a radial direction of the cylindrical portion 111, are formed in the cylindrical portion 111. The first holes 11*b* of the embodiment are formed in a size that allows a stick-shaped tool to be inserted therein. The plurality of (four, in the embodiment) of first holes 11*b* are formed so as to be separated apart from each other in a circumferential direction of the cylindrical portion 111.

Figure 6:
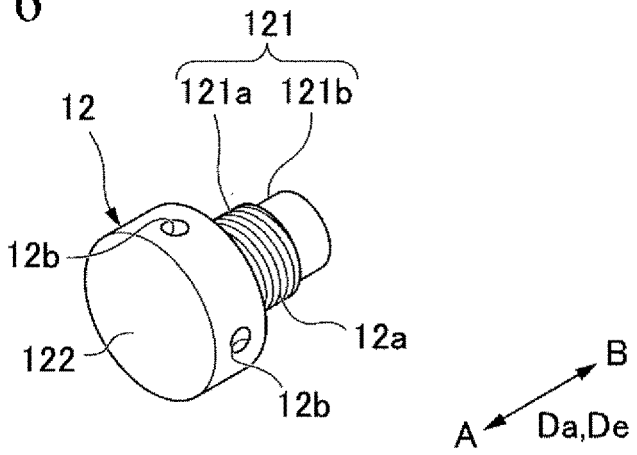
FIG. 6 is a perspective view showing appearance of a second member according to the embodiment.

As shown in FIG. 4, the second member 12 is provided so as to be relatively movable with respect to the first member 11 in the axial direction Da. As shown in FIG. 6, the second member 12 of the embodiment has an insertion portion 121 and a flange portion 122.

The insertion portion 121 can be inserted into the cylindrical portion 111 from the first side A in the axial direction Da. The insertion portion 121 of the embodiment has a columnar shape having an outer circumferential surface that can come into sliding contact with the inner circumferential surface of the cylindrical portion 111. The insertion portion 121 has the same diameter as the first end portion 3*a* of the rotor 3. In part of the outer circumferential surface thereof, the insertion portion 121 has a screw region 121*a* where a male screw portion 12*a* is formed and a decreased diameter region 121*b* formed on a tip side of the screw region 121*a*. The male screw portion 12*a* can engage with the female screw portion 11*a*. The decreased diameter region 121*b* is formed on the tip side of the screw region 121*a* (the second side B in the axial direction Da). The decreased diameter region 121*b* is formed to have a diameter smaller than that of the screw region 121*a*. The decreased diameter region 121*b* may have a tapered shape such that the diameter thereof gradually decreases toward the tip side.

The flange portion 122 protrudes to an outer side in the radial direction from an end portion of the insertion portion 121 on the first side A in the axial direction Da. The flange portion 122 of the embodiment is formed on an opposite side to the decreased diameter region 121*b* in the axial direction Da with the screw region 121*a* placed therebetween. The flange portion 122 is formed to have a diameter larger than that of the screw region 121*a*. The flange portion 122 has a disk shape. A plurality of second holes 12*b*, which are recessed from an outer circumferential surface of the flange portion 122 toward the inner side in the radial direction, are formed in the flange portion 122. The second holes 12*b* of the embodiment are formed in a size that allows a stick-shaped tool to be inserted therein. The plurality of (four, in the embodiment) of second holes 12*b* are formed so as to be separated apart from each other in a circumferential direction of the flange portion 122. The second holes 12*b* have the same shape as the first holes 11*b*.

Figure 3:
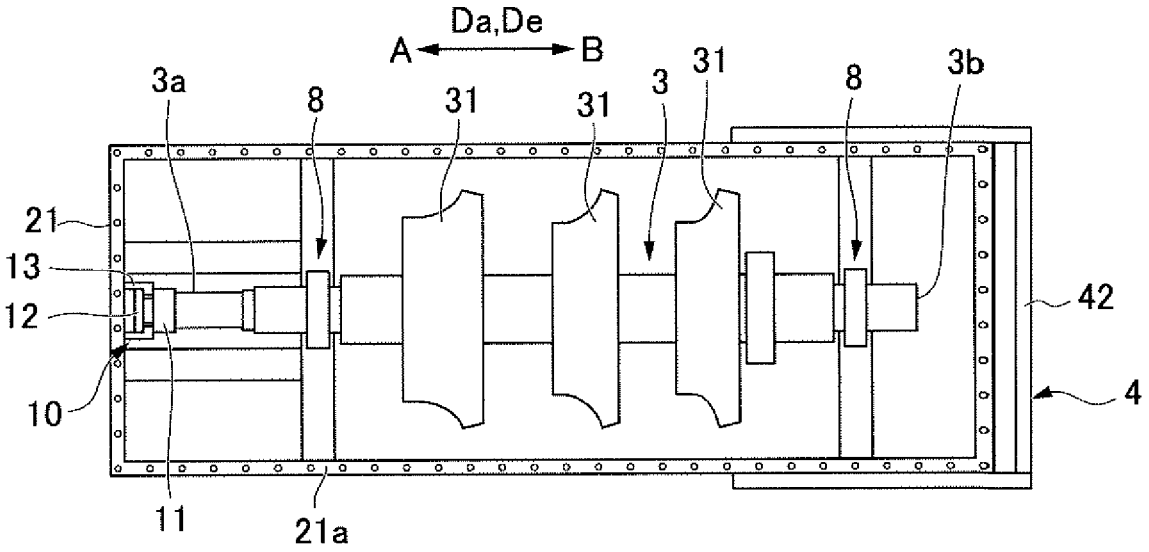
FIG. 3 is a top view showing appearance in which the upper half portion of the rotor storage unit according to the embodiment is open.
Figure 4:
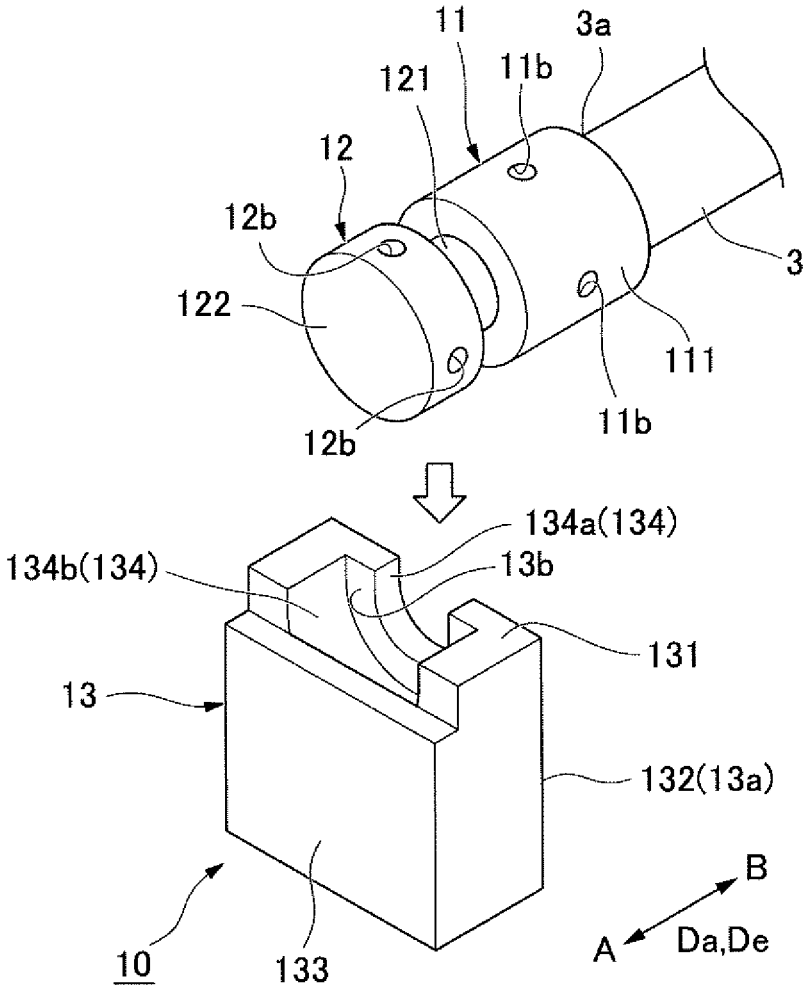
FIG. 4 is a perspective view showing appearance of a rotor securing jig according to the embodiment.
Figure 7:
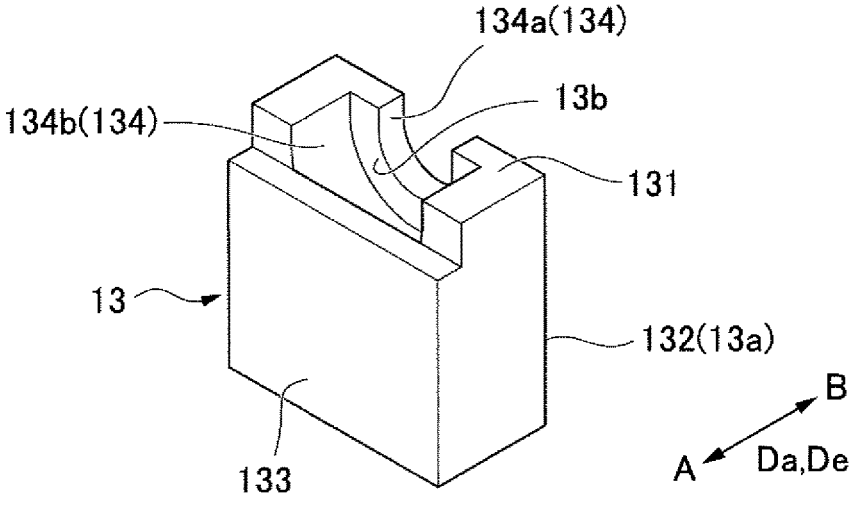
FIG. 7 is a perspective view showing appearance of a third member according to the embodiment.

As shown in FIGS. 2 and 3, the third member 13 is secured to the container 2. A first abutting surface 13*a* of the third member 13, which faces the second side B in the axial direction Da, abuts the first member 11. A second abutting surface 13*b* of the third member 13, which faces the first side A in the axial direction Da, abuts the second member 12. Specifically, the third member 13 of the embodiment is secured to an inner circumferential surface of the lower half container 21 on the first side A in the axial direction Da. As shown in FIG. 7, in a state of being secured to the container 2, the third member 13 has a rectangular box shape of which a side is open to the same side to which the lower half container 21 is open. The third member 13 is secured to the container 2 such that part thereof protrudes from the lower half container 21. More specifically, an upper surface 131 of the third member 13, which is a surface in which an opening is formed, is disposed at a position where the upper surface 131 projects to an upper half container 22 side of a contact surface of the lower half container 21 with the upper half container 22. Therefore, in a case where the container 2 is placed horizontally, the upper surface 131 is disposed at a position where the upper surface 131 projects toward the upper side of the lower half container 21 in the vertical direction Dv. A first surface 133 of the third member 13, which is a surface facing the first side A in the axial direction Da, is secured to the container 2. A second surface 132 of the third member 13, which is a surface facing the second side B in the axial direction Da, is formed as the first abutting surface 13*a*. A recessed storage portion 134 that can store the second member 12 is formed in the third member 13.

The recessed storage portion 134 is a space that communicates with the opening formed in the upper surface 131. The recessed storage portion 134 is recessed from the upper surface 131 so as to correspond to the shapes of the insertion portion 121 and the flange portion 122. Specifically, the recessed storage portion 134 is configured by a first recessed portion 134*a* and a second recessed portion 134*b*.

The first recessed portion 134*a* has a semicircular shape when seen from the axial direction Da and is recessed from the upper surface 131 so as to correspond to the insertion portion 121 having a columnar shape.

The second recessed portion 134*b* continues on the first side A in the axial direction Da with respect to the first recessed portion 134*a*, and is recessed from the upper surface 131. The second recessed portion 134*b* has a semicircular shape having a diameter larger than that of the first recessed portion 134*a* when seen from the axial direction Da and is recessed so as to correspond to the flange portion 122 having a disk shape. Therefore, a surface facing the first side A in the axial direction Da, is formed between the second recessed portion 134*b* and the first recessed portion 1134*a*. This surface is the second abutting surface 13*b*.

As shown in FIGS. 2 and 3, the second rotor securing jigs 8 secure the rotor 3 inside the container 2 along with the first rotor securing jig 10. The second rotor securing jigs 8 regulate the movement of the rotor 3, which is inside the container 2, in a radial direction. The second rotor securing jigs 8 of the embodiment are provided at two places separated in the axial direction Da. Specifically, the second rotor securing jigs 8 are disposed so as to correspond to portions of the rotor 3, which are supported by bearings. Just as the container 2, each of the second rotor securing jigs 8 can be divided into a lower half securing unit 81 and an upper half securing unit 82. The lower half securing unit 81 is secured to the lower half container 21 via a securing member such as H-section steel. The upper half securing unit 82 can be secured to the lower half securing unit 81. The second rotor securing jigs 8 restrain the position of the rotor 3 in the radial direction by the rotor 3 being sandwiched between the upper half securing units 82 from the outer side in the radial direction in a state where the rotor 3 is disposed on the lower half securing units 81.

As shown in FIG. 2, the rotor 3 is stored into the lower half container 21, which is in a state of being placed horizontally and being without the upper half container 22, in such a rotor storage unit 1. First, the first member 11 is attached to the first end portion 3*a* of the rotor 3. Specifically, the female screw portion 11*a* of the cylindrical portion 111 is screwed from the first side A in the axial direction Da with the male screw portion formed in the outer circumferential surface of the first end portion 3*a* of the rotor 3. After then, the second member 12 is attached to the first member 11 secured to the rotor 3. Specifically, the insertion portion 121 is inserted while being rotated from the first side A of the cylindrical portion 111, and the male screw portion 12*a* of the screw region 121*a* and the female screw portion 11*a* of the cylindrical portion 111 are screwed with each other. Accordingly, the second member 12 is connected to the first member 11. At this time, the second member 12 is attached to the first member 11 in a state of not falling off from the first member 11, and a state of being movable so as to approach the first member 11.

In this state, the second member 12 is stored into the recessed storage portion 134, and the rotor 3 is laid onto the lower half securing units 81 of the second rotor securing jigs 8. Specifically, in a state where the second abutting surface 13*b* and the flange portion 122 are separated from each other and the first abutting surface 13*a* and the cylindrical portion 111 are separated from each other, the second member 12 is stored into the recessed storage portion 134. In addition, in a state where the rotor 3 is laid on the lower half securing units 81, the rotor 3 is sandwiched from the upper side in the vertical direction Dv by the upper half securing units 82, and the upper half securing units 82 are secured to the lower half securing units 81. Accordingly, the position of the rotor 3 in the radial direction with respect to the lower half container 21 is restrained. The second member 12 is moved so as to approach the first member 11, and the flange portion 122 of the second member 12 is brought into contact with the second abutting surface 13*b* of the third member 13. Therefore, a surface of the cylindrical portion 111 of the first member 11, which faces the first side A in the axial direction Da, is brought into contact with the first abutting surface 13*a* of the third member 13. Accordingly, the position of the rotor 3 in the axial direction Da with respect to the lower half container 21 is restrained.

Figure 8:
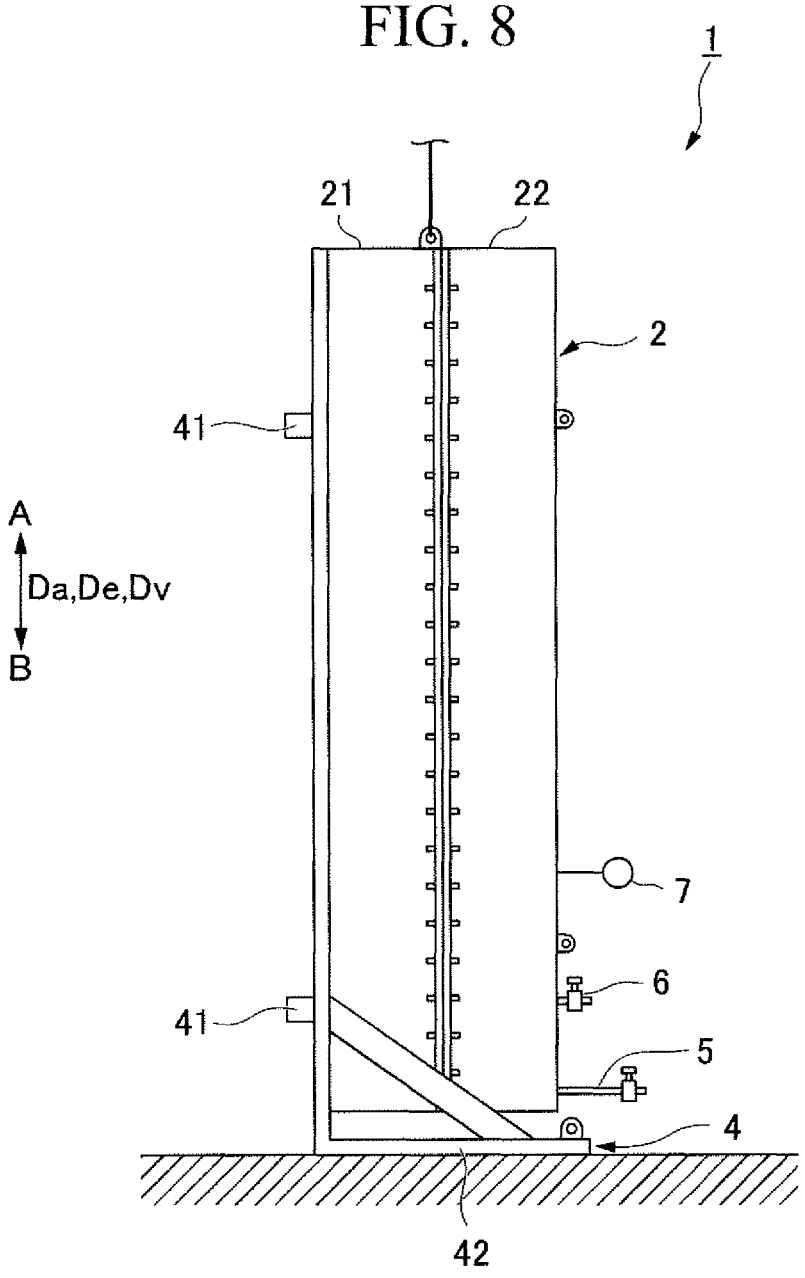
FIG. 8 is a schematic view showing appearance of the rotor storage unit according to the embodiment when keeping a rotor.

After the position of the rotor 3 is secured in the axial direction Da and the radial direction, the upper half container 22 is attached to the lower half container 21 and is secured with a bolt. Accordingly, as shown in FIG. 1, the rotor 3 is stored in a sealed state inside the container 2. In this state, the rotor storage unit 1 is transported to a storage place for keeping the rotor 3, such as a warehouse. After the rotor 3 is transported to the storage place, the rotor storage unit 1 is placed vertically as shown in FIG. 8. After then, air inside the container 2 is released by the discharge valve 5 while checking the internal pressure state of the container 2 with the pressure gauge 7, and is replaced with a gas, which is supplied from the supply valve 6 and is suitable for keeping the rotor 3. In this state, the rotor 3 is kept inside the container 2 in the long term.

In such a rotor storage unit 1 and such a first rotor securing jig 10, the first member 11 abuts the first abutting surface 13*a* of the third member 13, and the second member 12 abuts the second abutting surface 13*b* by the second member 12 relatively moving so as to approach the first member 11 secured to the first end portion 3*a* of the rotor 3 in the axial direction Da. Accordingly, the third member 13 is sandwiched between the first member 11 and the second member 12, the positions of the first member 11 and the second member 12 in the axial direction Da with respect to the third member 13 are secured. Accordingly, the position of the first member 11, which is secured to the first end portion 3*a* of the rotor 3, in the axial direction Da with respect to the third member 13, which is secured to the container 2, is secured. Therefore, the position of the rotor 3 in the axial direction Da with respect to the container 2 can be secured only with the first end portion 3*a* of the rotor 3. Accordingly, the position of the rotor 3 in the axial direction Da with respect to the container 2 can be secured without securing the second end portion 3*b* of the rotor 3 in the axial direction Da to the container 2.

In addition, in a case where the container 2 is placed vertically in order to keep the rotor 3 as in the embodiment, there is a possibility that the weight of the rotor 3 causes the second end portion 3*b*, which is positioned on a lower side in the vertical direction Dv, to deform if both ends of the rotor 3 in the axial direction Da are fixed to the container 2. For this reason, in a case where both ends of the rotor 3 in the axial direction Da are secured to the container 2, it is necessary to make adjustment with the upper half container 22 removed when placing the container 2 vertically, such that a gap is provided between the second end portion 3*b* of the rotor 3. However, it is not necessary to make adjustment to provide a gap between the second end portion 3*b* of the rotor 3 and the container 2 when placing the container 2 vertically by the first rotor securing jig 10 securing the position of the rotor 3 in the axial direction Da with the use of only the first end portion 3*a* of the rotor 3 to provide the gap between the second end portion 3*b* and the container 2 as in the embodiment. Therefore, it is possible to reduce man-hours when keeping the rotor 3.

The relative movement of the second member 12 in the axial direction Da with respect to the first member 11 can be guided by inserting the insertion portion 121 into the cylindrical portion 111. In addition, the third member 13 is sandwiched between the flange portion 122 and the cylindrical portion 111 by the flange portion 122, which protrudes from the insertion portion 121, and the cylindrical portion 111 abutting the third member 13, in a state where the insertion portion 121 is inserted in the cylindrical portion 111. In this manner, with a simple configuration where the first member 11 is provided with the cylindrical portion 111 and the second member 12 is provided with the insertion portion 121 and the flange portion 122, the second member 12 can be stably and relatively moved with respect to the first member 11 while the positions of the first member 11 and the second member 12 in the axial direction Da with respect to the third member 13 can be secured.

In addition, the female screw portion 11*a* in the inner circumferential surface of the cylindrical portion 111 having a cylindrical shape engages with the male screw portion 12*a* in the outer circumferential surface of the insertion portion 121 having a columnar shape. Accordingly, the relative position of the second member 12 with respect to the first member 11 can be secured and moved simply by rotating and inserting the insertion portion 121 into the cylindrical portion 111. Therefore, the relative position of the second member 12 with respect to the first member 11 can be adjusted with high accuracy, and the position of the rotor 3 in the axial direction Da with respect to the container 2 can be secured.

In addition, the first holes 11*b* are formed in the outer circumferential surface of the cylindrical portion 111. For this reason, in a case where the cylindrical portion 111 is screwed with the first end portion 3*a* of the rotor 3, a member, such as a stick-shaped tool, is plugged into the first holes 11*b*, and the cylindrical portion 111 can be rotated. Therefore, even if mass is great and it is difficult to rotate the cylindrical portion 111, the cylindrical portion 111 can be rotated with high accuracy.

In addition, the second holes 12*b* are formed in the outer circumferential surface of the flange portion 122. For this reason, in a case where the second member 12 is rotated and moved with respect to the first member 11, a member, such as a stick-shaped tool, is plugged into the second holes 12*b*, and the second member 12 can be rotated. Therefore, even if mass is great and it is difficult to rotate the second member 12, the second member 12 can be rotated with high accuracy.

In addition, the second rotor securing jigs 8 restraining the position of the rotor 3 in the radial direction are provided separately from the first rotor securing jig 10. For this reason, the positions of the rotor 3 in the axial direction Da and in radial direction inside the container 2 can be separately restrained. Accordingly, the rotor 3 with respect to the container 2 can be more reliably secured such that rattling is reduced.

Although the embodiment of the present invention has been described in detail with reference to the drawings hereinbefore, respective configurations, combinations of the configurations of the embodiment, and the like are merely examples. It is possible to make addition, omission, replacement, and other modifications of a configuration without departing from the scope of the present invention. In addition, the present invention is not limited by the embodiment, and is limited only by claims.

The first member 11 and the second member 12 are not limited to a structure in which the first member 11 and the second member 12 are made relatively movable by engaging the female screw portion 11*a* formed in the inner circumferential surface of the cylindrical portion 111 with the male screw portion 12*a* formed in the outer circumferential surface of the insertion portion 121 as in the embodiment. The first member 11 and the second member 12 may be made relatively movable in the axial direction Da via a separate connecting member such as a bolt and a nut.

In addition, the third member 13 is not limited to a rectangular box shape as in the embodiment. It is sufficient that the third member 13 have a shape that allows the first abutting surface 13*a* and the second abutting surface 13*b* to be formed and the third member 13 to be sandwiched between the first member 11 and the second member 12 in the axial direction Da. Therefore, the third member 13 may be, for example, a flat plate-shaped member extending from a bottom portion of the lower half container 21 toward the opening.

INDUSTRIAL APPLICABILITY

In the rotor securing jig and the rotor storage unit 1, the position of the rotor 3 in the axial direction Da with respect to the container 2 can be secured without securing one end portion of the rotor 3 in the axial direction Da to the container 2.

REFERENCE SIGNS LIST

1: rotor storage unit
2: container
21: lower half container
21*a*: lower half flange
22: upper half container
22*a*: upper half flange
3: rotor
31: impeller
3*a*: first end portion
3*b*: second end portion
Da: axial direction
A: first side
B: second side
De: extending direction
Dv: vertical direction
4: container supporting body
41: first supporting portion
42: second supporting portion
5: discharge valve
6: supply valve
7: pressure gauge
10: first rotor securing jig
11: first member
111: cylindrical portion
11*a*: female screw portion
11*b*: first hole
12: second member
121: insertion portion
121*a*: screw region
12*a*: male screw portion
121*b*: decreased diameter region
122: flange portion
12*b*: second hole
13: third member
131: upper surface
133: first surface

132: second surface
134: recessed storage portion
134*a*: first recessed portion
134*b*: second recessed portion
13*a*: first abutting surface
13*b*: second abutting surface
8: second rotor securing jig
81: lower half securing unit
82: upper half securing unit

What is claimed is:

1. A rotor securing jig comprising:

a first member that is able to be secured to a first end portion of a rotor, which is an end the portion of the rotor on a first side in an axial direction;

a second member that is provided relatively movable in the axial direction with respect to the first member; and a third member that is configured to be secured to a container, and has a first abutting surface facing a second side in the axial direction, which is an opposite side to the first side, and configured to abut the first member, and a second abutting surface facing the first side and configured to abut the second member, wherein the first member is separate from the rotor, the first member has a cylindrical portion that is configured to allow the first end portion of the rotor to be inserted therein from the second side, the second member has an insertion portion that is configured to be inserted into the cylindrical portion from the first side and a flange portion that protrudes outward from an end portion of the insertion portion on the first side in a radial direction, the first member and the second member are relatively movable in a state where the insertion portion is inserted in an inner circumferential surface of the cylindrical portion, and the first abutting surface of the third member comes into contact with the cylindrical portion, and the second abutting surface comes into contact with the flange portion.

2. The rotor securing jig according to claim 1, wherein the cylindrical portion has a cylindrical shape, the insertion portion has a columnar shape having an outer circumferential surface that is configured to come into sliding contact with the inner circumferential surface of the cylindrical portion, and the first member and the second member are relatively movable by engaging a female screw portion formed in the inner circumferential surface of the cylindrical portion with a male screw portion formed in the outer circumferential surface of the insertion portion.

3. The rotor securing jig according to claim 2, wherein a first hole recessed in the radial direction is formed in an outer circumferential surface of the cylindrical portion.

4. The rotor securing jig according to claim 2, wherein a second hole recessed in the radial direction is formed in an outer circumferential surface of the flange portion.

5. A rotor storage unit comprising:

the rotor securing jig according to claim 1; and a container to which the third member of the rotor securing jig is secured, wherein an inside of the container is sealable.

6. The rotor securing jig according to claim 3, wherein a second hole recessed in the radial direction is formed in an outer circumferential surface of the flange portion.

7. A rotor storage unit comprising:

the rotor securing jig according to claim 1; and a container to which the third member of the rotor securing jig is secured, wherein an inside of the container is sealable.

8. A rotor storage unit comprising:

the rotor securing jig according to claim 2; and a container to which the third member of the rotor securing jig is secured, wherein an inside of the container is sealable.

9. A rotor storage unit comprising:

the rotor securing jig according to claim 3; and a container to which the third member of the rotor securing jig is secured, wherein an inside of the container is sealable.

10. A rotor storage unit comprising:

the rotor securing jig according to claim 4; and a container to which the third member of the rotor securing jig is secured, wherein an inside of the container is sealable.

11. A rotor storage unit comprising:

the rotor securing jig according to claim 6; and a container to which the third member of the rotor securing jig is secured, wherein an inside of the container is sealable.

* * * * *